US006616126B1

(12) United States Patent
Barrios et al.

(10) Patent No.: US 6,616,126 B1
(45) Date of Patent: Sep. 9, 2003

(54) STRUT STRING COMPRESSOR TOOL AND METHOD

(75) Inventors: Jose Barrios, Owatonna, MN (US); James Jirele, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/212,096

(22) Filed: Aug. 6, 2002

(51) Int. Cl.[7] ..... B25B 19/04
(52) U.S. Cl. ..... 254/10.5; 29/227
(58) Field of Search ..... 254/10.5; 29/227, 29/225, 226, 259, 215, 216, 217, 218

(56) References Cited

U.S. PATENT DOCUMENTS

| | | | | |
|---|---|---|---|---|
| 3,912,224 A | * | 10/1975 | Castoe | 254/10.5 |
| RE34,097 E | * | 10/1992 | Kloster | 267/177 |
| 5,172,889 A | * | 12/1992 | Post | 254/10.5 |
| 6,129,339 A | * | 10/2000 | Lundgreen | 254/10.5 |

* cited by examiner

*Primary Examiner*—Joseph J. Hail, III
*Assistant Examiner*—Daniel Shanley
(74) *Attorney, Agent, or Firm*—Baker & Hostetler LLP

(57) ABSTRACT

A chartered type MacPherson strut spring compressor having a pivot adapter to permit force from the head of a forcing screw to the open surface of a trunion.

18 Claims, 3 Drawing Sheets

STRUT STRING COMPRESSOR TOOL AND METHOD

FIELD OF THE INVENTION

The present invention relates generally to tools and methods used to compress a spring. More particularly, the invention relates to compressor tools and methods used to compress springs such as MacPherson type strut springs. Even more particularly, the invention relates to tools and methods utilizing a clam shell style strut spring compressor.

BACKGROUND OF THE INVENTION

Coil springs are in wide use in vehicle suspension, such as car and truck suspensions. One type of coil suspension uses a MacPherson strut assembly which is a self-contained cartridge that has a coil spring surrounding a shock absorber.

Many types of tools and methods have been in use to compress a MacPherson strut spring. Compressing a MacPherson strut spring is needed for installation and removal of the strut and spring assembly. Accordingly, since many vehicles utilize MacPherson strut type suspensions, and the shock absorbers on other parts of MacPherson strut assemblies can wear out and require replacement, MacPherson strut spring compressor tools have found wide use in the vehicle servicing industry.

One known type of MacPherson strut string compressor is the so-called "clam shell" style spring compressor tool. This clam shell type compressor tool generally includes upper and lower arms pivotally attached at one of their ends, with the free ends having clips that engage the coil spring at relative vertical locations. The upper and lower arm pairs each have a trunion located somewhere along their length, and a threaded forcing screw that is threaded into a corresponding threaded hole in the lower trunion and passes through a bore in the upper trunion. A thrust washer assembly has been known to be disposed between the lower surface of the head of the forcing screw and the upper surface of the upper trunion against which it bears to apply compressive force when the forcing screw is tightened.

In prior art McPherson strut spring compressor tools of the clam shell type, it has been known for such a thrust washer assembly to consist of a hard steel washer followed by a softer bronze washer, both located directly below the head of the forcing screw, with the bronze washer abutting against the top of the trunion. It has further been known for the trunion in the region of the forcing screw in some instances to have a square section mounted over the generally cylindrical shape of the trunion, thereby providing a flat upper surface upon which the washer assembly bears. In this way, the generally flat bottom surface of the head of the forcing screw presses generally flat on the flat washers, which press generally flat on the flat top of the square upper trunion section.

The above described clam-shell type MacPherson strut spring compressor tools are in wide use. However, these assemblies suffer from some disadvantages. For example, due to the helical form of the coil spring being compressed, as the forcing screw is tightened to move the arms together, the upper and lower arm sets and their associated trunions do not remain completely parallel. As the trunions are forced out of parallel arrangement by the coil curvature of the spring, a bending load is placed on the forcing screw, and an uneven concentrated load is placed on one region of the washers. Because of the uneven concentrated load distribution, the washers tend to be subjected to a much higher compressive force at one region of the contact with the trunion surface compared to the remaining contact region.

The above-described uneven pressure on the washers can cause the washers to experience wear at the higher force locations. This problem can be exacerbated when a power tool such as an impact wrench is used to actuate the forcing screw. In some instances, the washers may fail eventually due to the wear.

Further, in situations where the washers do fail, if a user continues to use the tool without replacing the damaged washers, the head of the screw will contact the upper trunion surface with a similar degree of uneven pressure, causing the head of the screw to began to cut into the upper trunion, thereby potentially damaging the upper trunion further.

Additionally, the above-described interaction of the forcing screw head, washers, and upper trunion surface, provides a forcing action that tends to resist the tilting of the arms and trunions that naturally would result from the coil shape of the spring. These forces are passed to at least some degree back to the forcing screw itself, such that the forcing screw itself is subjected to bending loads which can undesirably affect the threaded connection between the forcing screw and the lower trunion. These bending loads can make the forcing screw harder to turn and/or can subject the lower threaded connection between the forcing screw and the lower trunion to undesirable wear.

Accordingly, it would be desirable to have a MacPherson strut spring compression tool and method that could overcome, to at least some degree, the wear and/or uneven loading problems described above.

SUMMARY OF THE INVENTION

In one aspect, the invention provides an apparatus for compressing a coil spring comprising a hinge assembly. The apparatus further includes a first pair of arms each having one end connected to the hinge assembly and a free end, and a second pair of arms each having one end connected to the hinge assembly and a free end. A first trunion connects the first pair of arms to each other and has a first bore therethrough. Likewise, a second trunion connects the second pair of hinge arms to each other and has a second bore therethrough. A forcing screw having a head portion and a body portion passes through the first bore in the first trunion and threadably engages with the second bore in the second trunion. An adapter having a first surface is disposed to receive force from the head of the forcing screw and has a curved surface that presses against the first trunion.

In another aspect, the invention provides an apparatus for compressing a coil spring comprising a first pair of arms and a second pair of arm. A means for hingedly connecting the first pair of arms to the second pair of arms is also provided. The invention further includes a first connecting means for connecting the first pair of arms to each other and a second means for connecting the second pair of arms to each other. A forcing means passes through a bore in the first trunion and engages the second connecting means. A force transmitting means is disposed to receive the compressive force from the forcing means and transmits the compressive force to the first connecting means. The apparatus also provides a pivoting means for connecting the force transmitting means to pivot relative to the first connecting means.

In still another aspect, the invention provides a method of compressing a respective pair of first arms towards a respective pair of pivotally connected second arms via a first trunion connecting the first arms and a second trunion connecting the second arms. The method includes providing a forcing screw that passes through a bore in the first trunion and threadably engages the second trunion. A pivot adapter is provided between the head of a forcing screw and a surface of the first trunion with a curved surface of the pivot adapter bearing on the first trunion. The forcing screw is rotated to provide a force through the adapter to the first trunion through contact of the curved surface of the adapter with a surface on the first trunion.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The invention in some preferred embodiments provides a MacPherson strut spring compressor tool and method that includes an adapter having a curved surface that presses against a complementary curved surface on a trunion of the tool. A preferred embodiment of the present invention is illustrated in FIGS. 1–4, in which like numerals generally refer to like elements throughout.

Figure 1:
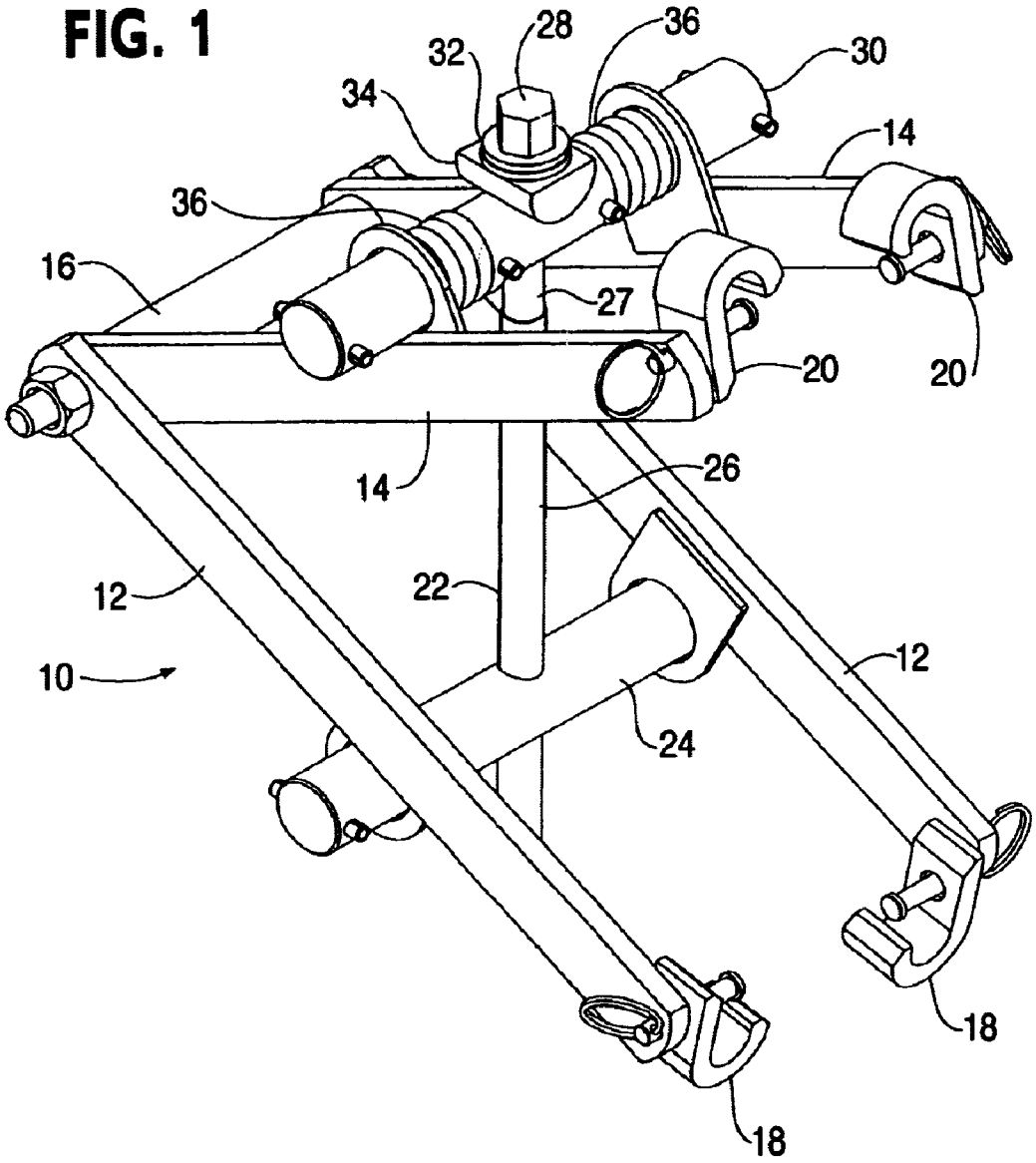
FIG. 1 is a perspective view of a MacPherson strut spring compressor tool according to a preferred embodiment of the invention.
Figure 2:
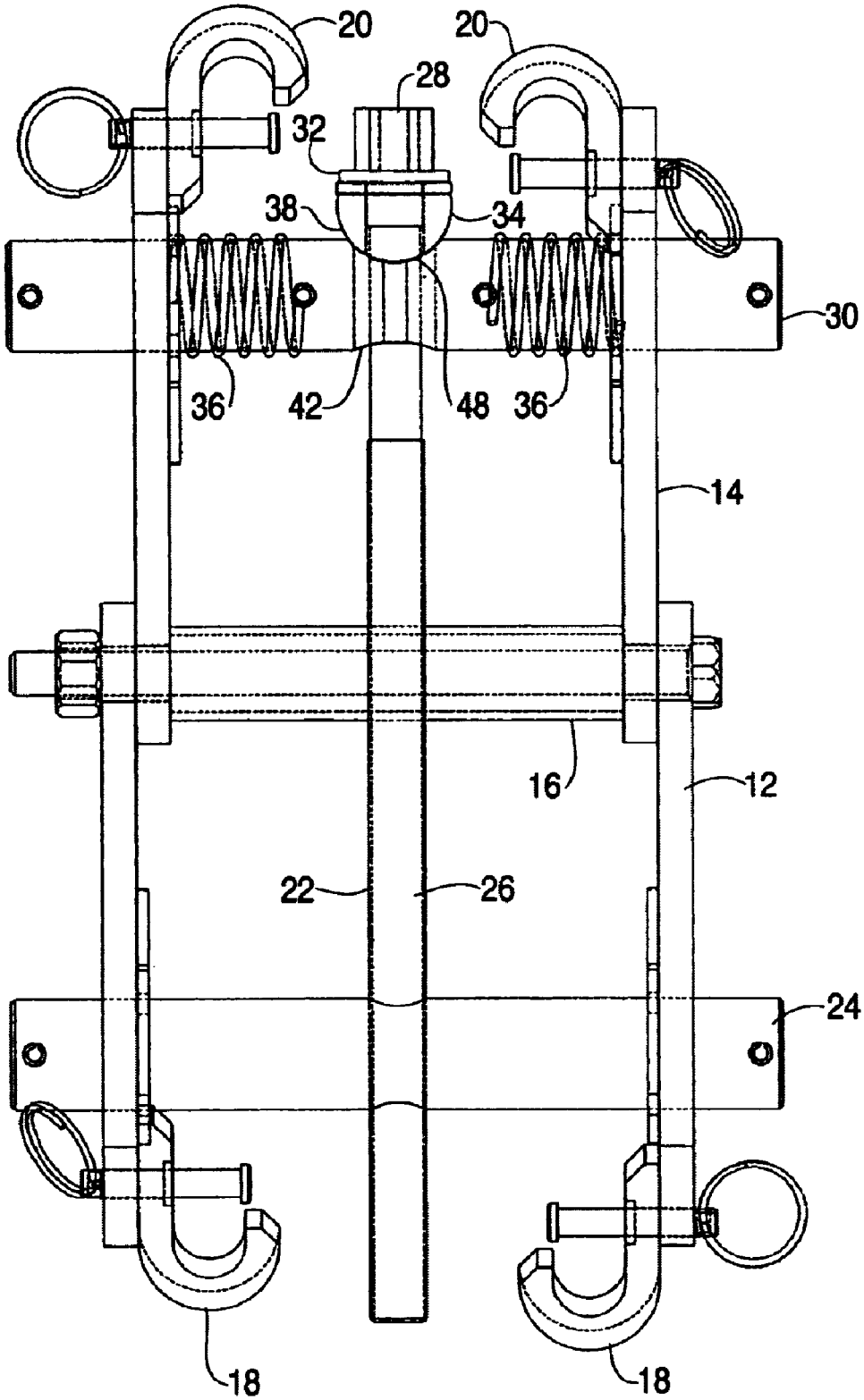
FIG. 2 is a front elevation view of the tool shown in FIG. 1.

Turning now particularly to FIGS. 1 and 2, there is shown a MacPherson strut spring compressor tool 10 having a pair of lower arms 12 pivotally connected to a pair of upper arms 14 via a hinge rod assembly 16. The lower arms 12 each have engagement hooks 18 at their free ends, and the upper arms 14 similarly have engagement hooks 20 at their free ends. It will be appreciated that the spring compressor tool 10 can be placed in an open position with its arms apart, and can be engaged on to a coil spring such that the hooks 18 and 20 connect over upper and lower regions of the spring to apply compressive force when the arms 12 and 14 are moved together.

The forcing of the free ends of the arms 12 and 14 together is accomplished by rotation of a forcing screw 22, which is in threaded engagement with a lower trunion 24 that is attached to the lower arms 12. The lower trunion 24 has a threaded bore threaded and sized to accept a threaded portion 26 of the forcing screw 22. The forcing screw 22 also has a top head 28, which may be a hex type head, or may have any other appropriate shape for being driven by either manual or power operated rotary driving tools. For example, the forcing screw 22 may be rotated by a manual or air driven socket wrench.

Rotating the forcing screw 22 in the appropriate direction causes the forcing screw to apply a downward force to the upper trunion 30 by contact of the head 28 preferably against a washer assembly 32 that bears against a pivot adapter 34. As discussed in more detail below, rotation of the forcing screw moves the arms 12 and 14 together to compress a spring. Return springs 36 may be provided as shown to apply a biasing force that tends to force the arms 14 away from one another and the forcing screw 22 thereby approximately keeping the forcing screw 22 centered between the two arms 14.

A washer assembly 32 can preferably be used and may be any suitable thrust washer assembly, including for example an upper, hard steel washer in contact with the bottom of the spring screw head 28, followed by a lower, soft bronze washer that is in contact with an upper surface of the pivot adapter 34. Further, the pivot adapter 34 has a curved lower surface 38 that rides in a saddle-shaped region 48 of the upper trunion bore 42, as described in more detail below. The curved lower surface 38 of the pivot adapter 34 is preferably cylindrical in shape. In some embodiments, the washer assembly 32 may be omitted so the head 28 bears directly on the pivot adapter 34.

Figure 3:
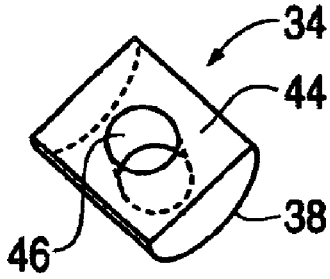
FIG. 3 is a perspective view of a pivot adapter used in the tool shown in FIG. 1.
Figure 4:
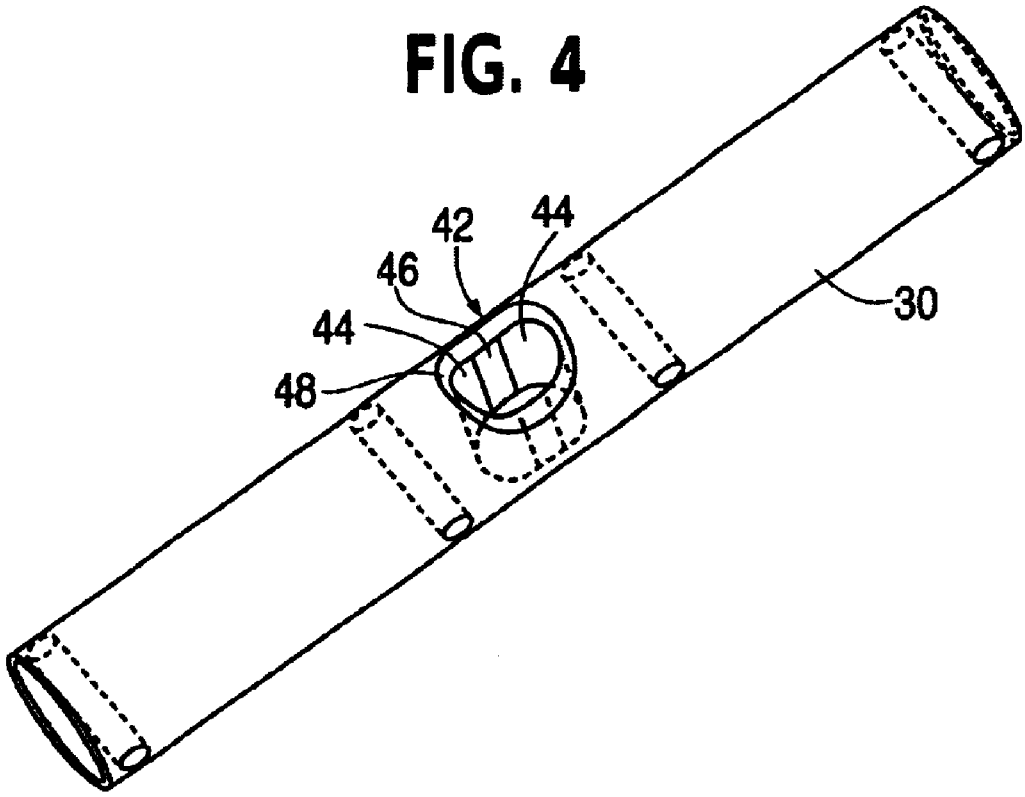
FIG. 4 is a perspective view of an upper trunion used in the tool of FIG. 1.

Turning now more in detail to FIGS. 3 and 4, the pivot adapter 34, in addition to the curved lower surface 38, has a substantially flat upper surface 44, and a bore 46 therethrough. The upper trunion 30 preferably has an elongated oval shaped bore 42, which has two oppressed semi-circular sides 44 and a pair of opposed substantially straight sides 46. This type of elongated bore shape 42 is particularly convenient to be manufactured with conventional metal fabricating machinery. A benefit of having the bore 42 be elongated in the longitudinal direction of the trunion is that this elongation of the hole 42 permits the forcing screw 22 to tilt off from a completely perpendicular axis relative to the upper trunion 30. Accordingly, this elongation of the bore 42 permits the trunion 30 itself to tilt relative to the generally vertical forcing screw 22 so that the respective ones of the upper arms 14 and lower arms 12 can be at slightly different heights and angled relative to each other to accommodate the coil shape of the spring being compressed. Instead of being elongated, the bore 42 can alternatively be round and oversized to have a substantial clearance around the direction of the forcing screw 22 to permit similar tilting.

In a further aspect of a preferred embodiment of the invention, the upper saddle surface 48, which forms the periphery around the elongated bore 42, has a saddle shape that is complementary to the curved shape of the lower surface 38 of the pivot adapter 34. In the preferred embodiment, the lower surface 38 of the pivot adapter has a cylindrical shape, and the saddle surface 48 is formed by a complementary cylindrical cut out that accepts the lower surface 38 of the pivot adapter 34.

Returning now to FIG. 1, it will be appreciated that when the user applies a compressive force by rotating the forcing screw 22, each of the lower arms 12, and each of the upper arms 14 will be provided some degree of independent movement, so that the upper trunion 30 is permitted to deviate to some degree from complete parallelism with the lower trunion 24. This degree of freedom is the result of the clearance of the bore 42 and also results from the adapter 34 having its lower surface 38 sliding and rotating relative to the trunion 30 in the lower surface 38 by pivoting with sliding contact on the saddle surface 48. This pivoting sliding motion allows the ends of the arms 12 and 14 to accommodate the curvature of the spring, and at the same time this degree of freedom reduces wear on the tool 10, particularly wear associated with the washer assembly 32 and trunion 30.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed:

1. An apparatus for compressing a coil spring comprising:

a hinge assembly;

a first pair of arms each having one end connected to the hinge assembly and a free end;

a second pair of arms each having one end connected to the hinge assembly and a free end;

a first trunion connecting the first pair of arms to each other and having a first bore therethrough;

a second trunion connecting the second pair of hinge arms to each other and having a second bore therethrough;

a forcing screw having a head portion, and a body portion passing through the first bore in the first trunion and threadably engaging with the second bore in the second trunion; and an adapter having a first surface disposed to receive force from the head of the forcing screw and having a curved surface that presses against the first trunion, wherein said curved surface has a cylindrical shape.

2. An adapter according to claim 1, wherein the first trunion has a saddle surface that has a shape complementary to a shape of the curved surface, and the curved surface of the adapter presses against the saddle surface.

3. An adapter according to claim 1, wherein the first trunion has a saddle surface that has a shape complementary to a shape of the curved surface, and the curved surface of the adapter presses against the saddle surface.

4. An apparatus according to claim 3, wherein the first surface is a flat surface.

5. An apparatus according to claim 1, wherein the first surface is a flat surface.

6. An apparatus according to claim 1, further comprising at least one thrust washer disposed between the head of the forcing screw and the first surface of the adapter.

7. An apparatus according to claim 1, wherein the first bore is elongated in a direction of the elongation of the first trunion.

8. An apparatus according to claim 1, wherein the forcing screw comprises a threaded portion and a non-threaded portion, and wherein the non-threaded portion extends through the first bore in the first trunion.

9. An apparatus according to claim 8, wherein the threaded portion engages the second bore.

10. An apparatus for compressing a coil spring comprising:

a first pair of arms;

a second pair of arms;

hinging means for hingedly connecting the first pair of arms to the second pair of arms;

first connecting means for connecting the first pair of arms to each other;

second connecting means for connecting the second pair of arms to each other;

forcing means passing through a bore in the first connecting means and engaging the second connecting means for applying a compressive force to force the first and second connecting means towards each other;

force transmitting means disposed to receive the compressive force from the forcing means that transmits the compressive force to the first connecting means; and pivoting means for connecting the force transmitting means to pivot relative to the first connecting means, said pivoting means further comprising a curved surface on the bore transmitting means wherein said curved surface has a cylindrical shape.

11. An apparatus according to claim 10, wherein the pivoting means further comprises a saddle surface on the first connecting means having a complementary shape to the curved surface.

12. An apparatus according to claim 10, wherein the forcing means has a head, and further comprising at least one thrust washer disposed between the head of the forcing means and the force transmitting means.

13. An apparatus according to claim 10, wherein the bore is elongated in the direction of the elongation of the first connecting means.

14. An apparatus according to claim 10, wherein the forcing means comprises a threaded portion and a non-threaded portion, and wherein the non-threaded portion extends through the bore in the first connecting means.

15. A method of compressing a respective pair of first arms towards a respective pair of pivotally connected second arms via a first trunion connecting the first arms and a second trunion connecting the second arms, comprising the steps of:

providing a forcing screw that passes through a bore in the first trunion and threadably engages the second trunion;

providing a pivot adapter between the head of a forcing screw and a surface of the first trunion with a curved cylindrical surface of the pivot adapter bearing on the first trunion; and rotating the forcing screw to provide a force through the adapter to the first trunion through contact of the curved surface of the adapter with a surface on the first trunion.

16. The method of claim 14, further comprising the step of permitting the adapter to pivot relative to the trunion.

17. The method of claim 14, further comprising the step of providing a saddle surface on the first barrier having a complementary shape to the curved cylindrical surface.

18. The method of claim 16, further comprising the step of permitting the adapter to pivot relative to the trunion.

* * * * *